US006102692A

United States Patent [19]

Döbbeling et al.

[11] Patent Number: 6,102,692

[45] Date of Patent: Aug. 15, 2000

[54] BURNER FOR A HEAT GENERATOR

[75] Inventors: Klaus Döbbeling, Windisch; Christian Steinbach, Neuenhof; Thomas Ruck, Mellingen, all of Switzerland

[73] Assignee: ABB Alstom Power (Switzerland) Ltd, Baden, Switzerland

[21] Appl. No.: 09/135,173

[22] Filed: Aug. 18, 1998

[30] Foreign Application Priority Data

Aug. 25, 1997 [DE] Germany ..... 197 36 902

[51] Int. Cl.[7] ..... F23D 14/64

[52] U.S. Cl. ..... 431/350; 431/354; 239/402

[58] Field of Search ..... 431/350, 354, 431/9, 182, 181, 185; 60/737; 239/399, 427.3, 402, 434, 466

[56] References Cited

U.S. PATENT DOCUMENTS

| | | | |
|---|---|---|---|
| Re. 33,896 | 4/1992 | Maghon et al. | 431/185 |
| 1,656,907 | 1/1928 | Bansen | 431/185 |
| 4,479,775 | 10/1984 | Wiesel | 431/181 |
| 4,932,861 | 6/1990 | Keller et al. . | |
| 5,244,380 | 9/1993 | Döbbeling et al. | 431/8 |
| 5,586,878 | 12/1996 | Döbbeling et al. | 431/351 |
| 5,735,687 | 4/1998 | Knöpfel et al. | 431/354 |
| 5,817,909 | 10/1998 | Lescuyer et al. | 431/9 |
| 5,876,196 | 3/1999 | Knöpfel et al. | 431/354 |

FOREIGN PATENT DOCUMENTS

| | | | |
|---|---|---|---|
| 2154941 | 4/1996 | Canada . | |
| 2190805 | 6/1997 | Canada . | |
| 0704657 | 4/1996 | European Pat. Off. . | |
| 780630 | 6/1997 | European Pat. Off. . | |
| 0797051 | 9/1997 | European Pat. Off. . | |
| 953551 | 11/1956 | Germany | 431/182 |
| 1936416 | 1/1970 | Germany . | |
| 19547913A1 | 6/1997 | Germany . | |
| 1295144 | 3/1987 | U.S.S.R. | 431/354 |
| WO95/02789 | 1/1995 | WIPO . | |

*Primary Examiner*—James C. Yeung
*Assistant Examiner*—Sara Clarke
*Attorney, Agent, or Firm*—Burns, Doane, Swecker & Mathis, L.L.P.

[57] ABSTRACT

In a burner for a heat generator, having a swirl generator (100) arranged upstream of the combustion zone (30), fuel injection is connected with the combustion air (115), swirled in the swirl generator, in such a way that the injection angle of the fuel jet (105) belonging to the fuel nozzle (104) corresponds approximately to the setting angle of the sectional bodies forming the swirl generator relative to the axis (60) of the burner.

15 Claims, 6 Drawing Sheets

BURNER FOR A HEAT GENERATOR

BACKGROUND OF THE INVENTION

1. Field of the Invention

The present invention relates to a burner for a heat generator.

2. Discussion of Background

Low-pollution combustion of liquid fuels, such as, for example, fuel oil EL (=extra light), requires the complete vaporization of the fuel droplets as well as the premixing of the fuel with the combustion air before the flame front is reached. Even small zones having a higher fuel concentration lead to increased temperatures in the reaction zone and thus to increased formation of thermal nitrogen oxides.

It has become known from the prior art to atomize the oil with various designs of swirl- or air-assisted, central nozzles arranged on the head side of the premix section. However, the atomization quality which can thus be achieved is restricted in various operating modes of these burners. This is essentially connected with the fact that the impulse of the droplet spray formed from the fuel injection turns out to be relatively small, whereby directed introduction of this fuel into certain burner zones is inadequate or not possible at all.

Since the fuel droplets in the case of such a configuration are rapidly decelerated by the combustion air which flows into the premix section, they cannot be readily distributed radially in the inflowing combustion air. The consequence of this inadequate premixing is insufficient vaporization of the injected fuel, which is reflected in the fact that fuel-rich zones form on the burner axis, and these fuel-rich zones are then responsible for causing increased formation of thermal nitrogen oxides in the combustion zone.

SUMMARY OF THE INVENTION

Accordingly, one object of the invention, as defined in the claims, in a burner of the type mentioned at the beginning, is to propose measures by means of which perfect premixing of the fuel used is ensured while preserving operationally reliable and optimum flame positioning.

According to the invention, it is proposed to carry out the injection of the fuel at a certain radius from the burner axis.

The essential advantages of the invention may be seen in the fact that enrichment of the central zone is lastingly prevented, and the fuel droplets, with increasing radius inside the premix section, are subjected to a greater radial acceleration in such a way that they can readily intermix with the combustion air entering there.

In a burner swirl generator consisting of a premix section consisting of a plurality of shells, as disclosed, for example, by EP-B1-0 321 809, the wake zones along the lee side of the corresponding shell or respectively the guide blades of a correspondingly conceived swirl generator are readily suitable as the injection position for the fuel. There, the droplet spray is subjected to lower aerodynamic forces and it is accordingly intermixed radially with the combustion air in a more effective manner.

The number of injection points is adapted to the burner design, in which case at least one injection per shell or blade is to be provided.

According to the invention, the following further advantages are thus obtained in connection with a premix burner of the newer generation:

a) stable flame position;
b) lower pollutant emissions (CO, UHC, NOx);

c) minimization of the pulsations;
d) complete burn-out;
e) wide operational range covered;
f) good cross ignition between the various burners, in particular in the case of gradual provision of load, during which the burners are operated independently of one another;
g) the flame can be adapted to the corresponding geometry of the combustion chamber;
h) compact type of construction;
i) improved mixing of the flow media;
j) improved "pattern factor" of the temperature distribution in the combustion chamber (=compensated temperature profile of the combustion-chamber flow).

Advantageous and expedient developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
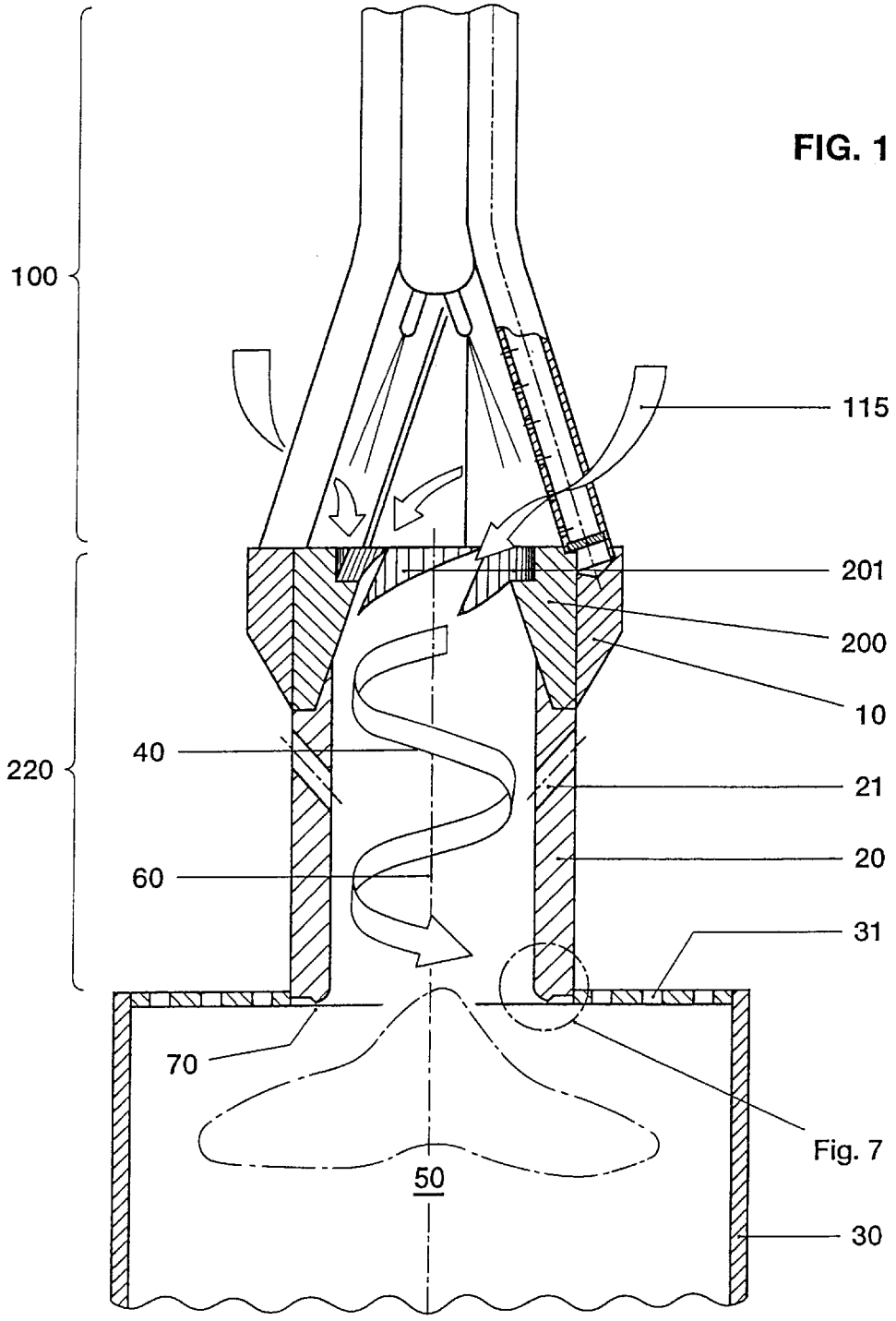
FIG. 1 shows a burner with adjoining combustion chamber.

Referring now to the drawings, wherein like reference numerals designate identical or corresponding parts throughout the several views, all features not essential for the direct understanding of the invention have been omitted, and the direction of flow of the media is indicated by arrows, FIG. 1 shows the overall construction of a burner. Initially a swirl generator 100 is effective, the configuration of which is shown and described in more detail below in FIGS. 2 to 5. This swirl generator 100 is a conical structure to which a combustion-air flow 115 entering tangentially is repeatedly admitted tangentially. The flow forming herein, with the aid of a transition geometry provided downstream of the swirl generator 100, is passed over smoothly into a transition piece 200 in such a way that no separation regions can occur there. The configuration of this transition geometry is described in more detail under FIG. 6. This transition piece 200 is extended on the outflow side of the transition geometry by a tube 20, both parts forming the actual mixing tube 220, also called mixing section, of the burner. The mixing tube 220 may of course be made in one piece, i.e. by the transition piece 200 and tube 20 being fused to form a single cohesive structure, the characteristics of each part being retained. If transition piece 200 and tube 20 are constructed from two parts, these parts are connected by a sleeve ring 10, the latter serving as an anchoring surface for the swirl generator 100 on the head side. In addition, such a sleeve ring 10 has the advantage that various mixing tubes can be used. Located on the outflow side of the tube 20 is the actual combustion chamber 30, which is symbolized here merely by the flame tube. The mixing tube 220 fulfills the condition that a defined mixing section, in which perfect premixing of fuels of various types is achieved, can be provided downstream of the swirl generator 100. Furthermore, this mixing section, that is, the mixing tube 220, enables the flow to be directed free of losses so that at first no backflow zone can form even in interaction with the transition geometry, whereby the mixing quality of all types of fuel can be influenced over the length of the mixing tube 220. However, this mixing tube 220 has another property, which consists in the fact that, in the mixing tube 220 itself, the axial velocity profile has a pronounced maximum on the axis, so that a flashback of the flame from the combustion chamber is not possible. However, it is correct to say that this axial velocity decreases toward the wall in such a configuration. In order to also prevent a flashback in this region, the mixing tube 220 is provided in the flow and peripheral directions with a number of regularly or irregularly distributed bores 21 having the most varied cross sections and directions, through which an air quantity flows into the interior of the mixing tube 220 and induces an increase in the velocity along the wall for the purposes of a prefilmer. Another possibility of achieving the same effect is for the cross section of flow of the mixing tube 220 on the outflow side of the transition passages 201, which form the transition geometry already mentioned, to undergo a convergence, as a result of which the entire velocity level inside the mixing tube 220 is raised. In the figure, these bores 21 run at an acute angle relative to the burner axis 60. Furthermore, the outlet of the transition passages 201 corresponds to the narrowest cross section of flow of the mixing tube 220. The said transition passages 201 accordingly bridge the respective difference in cross section without at the same time adversely affecting the flow formed. If the measure selected initiates an intolerable pressure loss when directing the tube flow 40 along the mixing tube 220, this may be remedied by a diffuser (not shown in the figure) being provided at the end of the mixing tube. A combustion chamber 30 adjoins the end of the mixing tube 220, there being a jump in cross section between the two cross sections of flow. Not until here does a central backflow zone 50 form, which has the properties of a flame retention baffle. If a fluidic marginal zone, in which vortex separations arise due to the vacuum prevailing there, forms inside this jump in cross section during operation, this leads to intensified ring stabilization of the backflow zone 50. At the end face, the combustion chamber 30 has a number of openings 31 through which an air quantity flows directly into the jump in cross section and, inter alia, helps to intensify the ring stabilization of the backflow zone 50. In addition, it must not be left unmentioned that the generation of a stable backflow zone 50 also requires a sufficiently high swirl coefficient in a tube. If such a high swirl coefficient is undesirable at first, stable backflow zones may be generated by the feed of small, intensely swirled air flows at the tube end, for example through tangential openings. It is assumed here that the air quantity required for this is approximately 5–20% of the total air quantity. As far as the injection of the fuel into the swirl generator is concerned, reference is made to the following FIGS. 2–5. The configuration of the breakaway edge at the end of the mixing tube 220 is described in more detail under FIG. 7.

Figure 2:
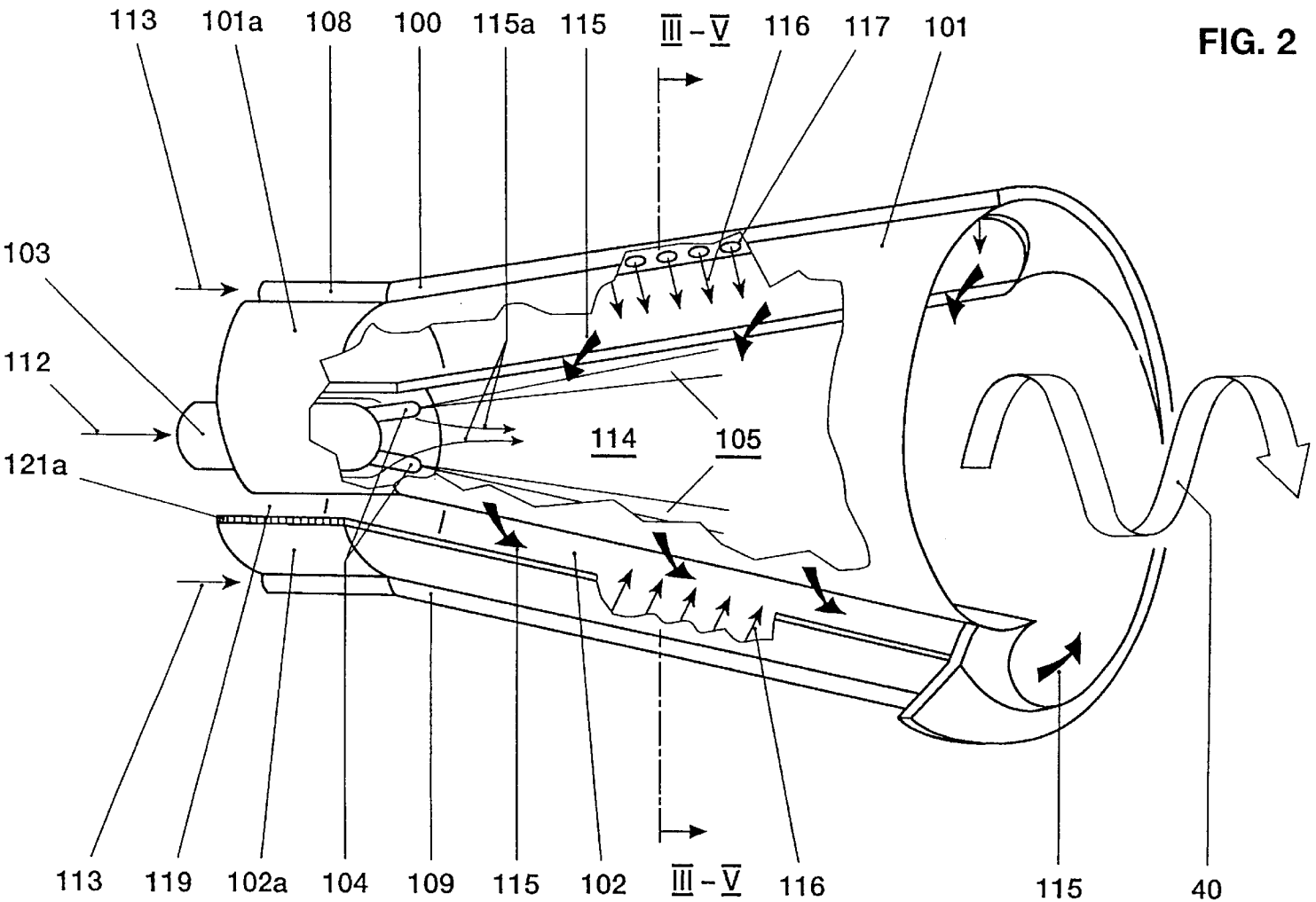
FIG. 2 shows a swirl generator in perspective representation, in appropriate cut-away section.
Figure 3:
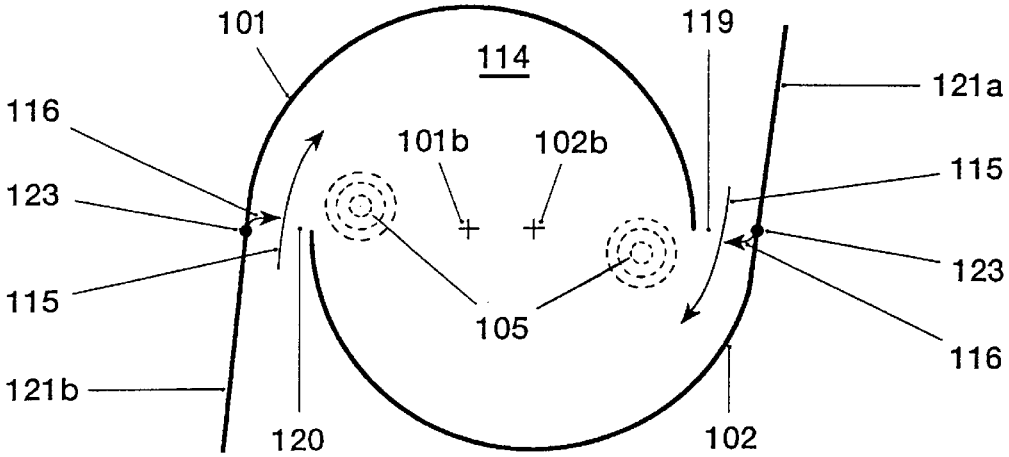
FIG. 3 shows a section through the two-shell swirl generator according to FIG. 2.

In order to better understand the construction of the swirl generator 100, it is of advantage if at least FIG. 3 is used at the same time as FIG. 2. Furthermore, so that this FIG. 2 is not made unnecessarily complex, the baffle plates 121*a*, 121*b* shown schematically according to FIG. 3 are only alluded to in FIG. 2. In the description of FIG. 2 below, the said figures are referred to when required.

Figure 4:
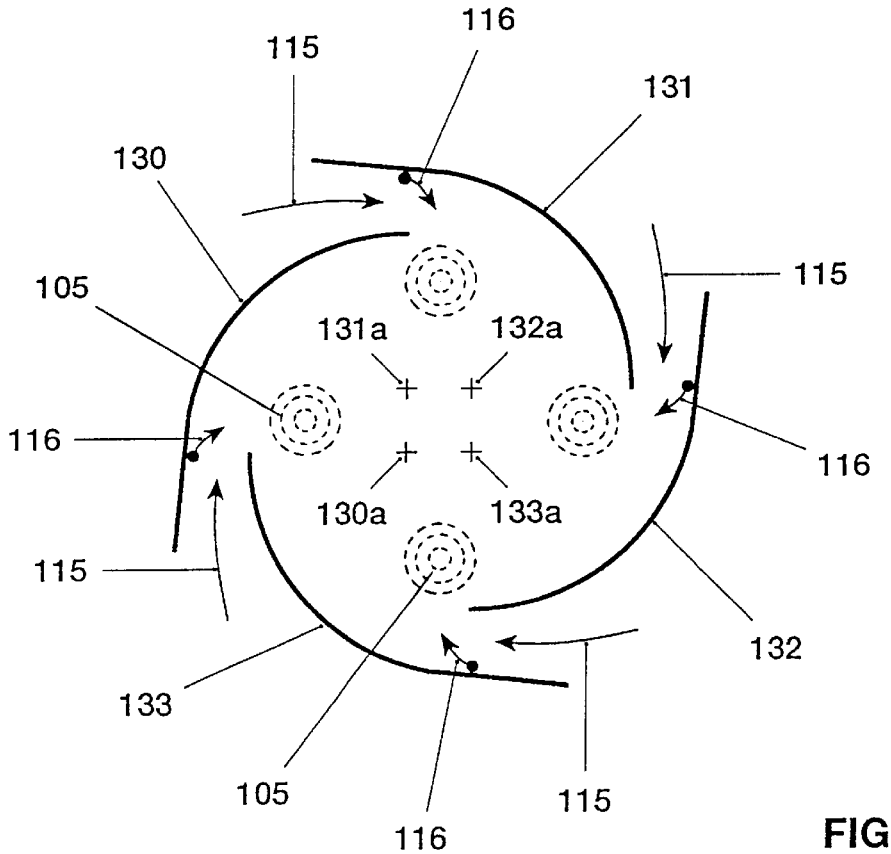
FIG. 4 shows a section through a four-shell swirl generator.
Figure 5:
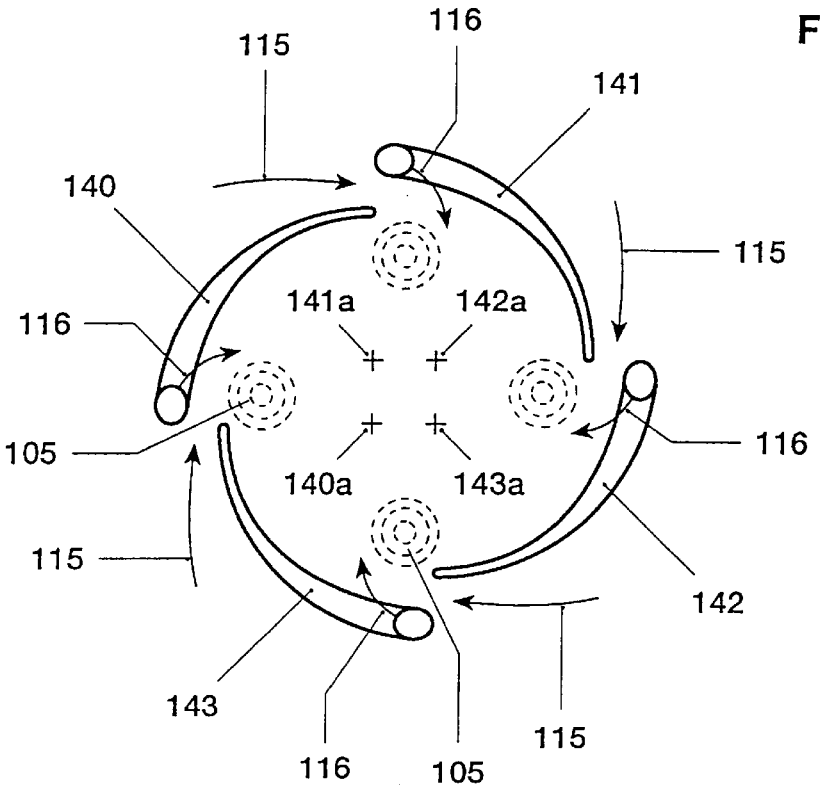
FIG. 5 shows a section through a swirl generator whose shells are profiled in a blade shape.

The first part of the burner according to FIG. 1 forms the swirl generator 100 shown according to FIG. 2. The swirl generator 100 consists of two hollow conical sectional bodies 101, 102 which are nested one inside the other in a mutually offset manner. The number of conical sectional bodies may of course be greater than two, as the examples under FIGS. 4 and 5 show. The number of conical sectional bodies depends in each case on which mode of operation is taken as a basis. It is not out of the question in certain operating configurations to provide a swirl generator consisting of a single spiral. The mutual offset of the respective center axis or longitudinal symmetry axes 101*b*, 102*b* of the conical sectional bodies 101, 102 provides at the adjacent wall, in mirror-image arrangement, one tangential duct each, i.e. an air-inlet slot 119, 120 (FIG. 3) through which the combustion air 115 flows into the interior space of the swirl generator 100, i.e. into the conical hollow space 114 of the same. The conical shape of the sectional bodies 101, 102 shown has a certain fixed angle in the direction of flow. Of course, depending on the operational use, the sectional bodies 101, 102 may have increasing or decreasing conicity in the direction of flow, similar to a trumpet or tulip respectively. The two last-mentioned shapes are not shown graphically, since they can readily be visualized by a person skilled in the art. The two conical sectional bodies 101, 102 each have a cylindrical initial part 101*a*, 102*a*, which parts likewise run offset from one another in a manner analogous to the conical sectional bodies 101, 102, so that the tangential air-inlet slots 119, 120 are present over the entire length of the swirl generator 100. Accommodated in the region of the cylindrical initial part is a main nozzle 103, preferably for a liquid fuel 112.

Figure 8:
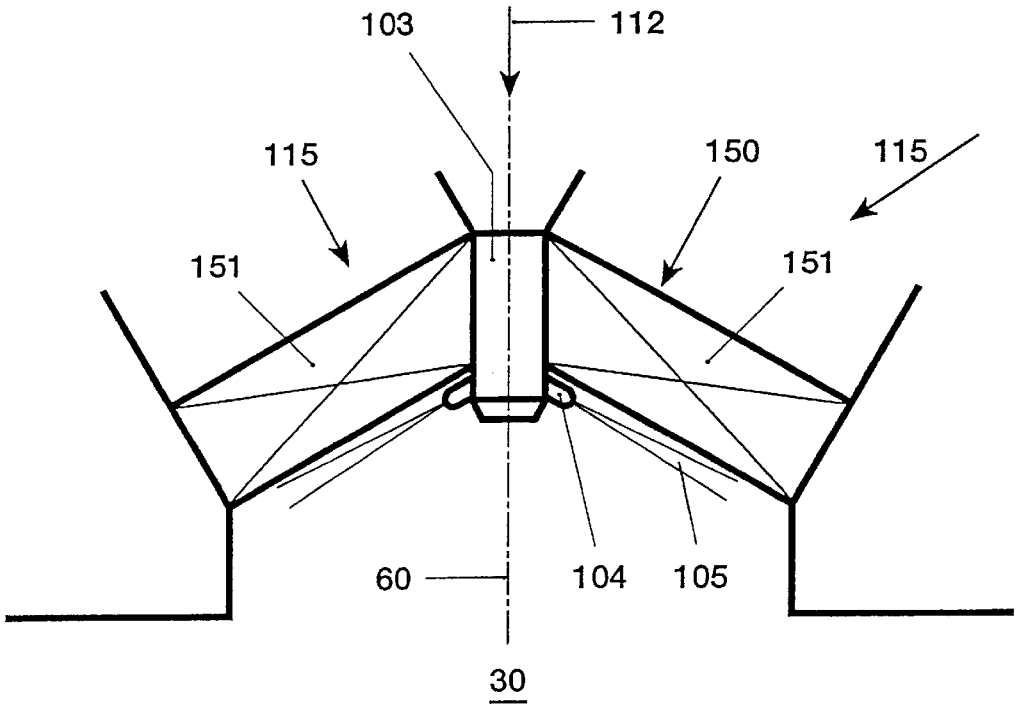
FIG. 8 shows a swirl generator with swirl blading.

The introduction of the fuel into the conical hollow space 114 takes place here via a non-central injection, which is carried out by a number of nozzle tubes 104. The angle of the fuel jet 105, formed from these nozzle tubes 104, relative to the burner axis (FIG. 1, item 60) roughly corresponds to the conical form of the sectional bodies 101, 102. If the swirl generator is constructed by a blade configuration which acts in one plane, the angle of the fuel jet 105 corresponds to the setting angle of the blades relative to the combustion-chamber axis. In this connection, reference is made to FIG. 8. The injection position, preferably to be provided, of the fuel jet 105 with regard to the inflow plane of the combustion air 115 is explained in more detail under FIGS. 3–5. The injection capacity and injection type of the individual nozzle tubes 104 depends on the predetermined parameters of the respective burner. Depending on the burner size, a turbulence-assisted pressure atomizing nozzle can preferably be provided at the individual nozzle tubes 104, in which case the injection pressure should be about 100 bar in order to achieve good atomization quality. The length of the nozzle tubes 104 is to be adapted to the requisite injection radius, but should not be more than ¼ of the sectional bodies or blade length respectively (FIG. 8), since otherwise there is the inherent risk of the nozzle tubes 104 acting as flame retention baffles during operation with gaseous fuels. A non-central injection, in which the nozzle tubes 104 emerge directly from the sectional bodies or blades respectively (FIG. 8) into the wake of the latter, is to be provided for long sectional bodies or blades respectively (FIG. 8). The fuel can thus be injected specifically into zones of high air velocity. Operation with minimized pollutant emissions can therefore also be maintained, and this operation does not need the addition of water. It is then essential that the fine atomization, in combination with a high fuel impulse, provides good preconditions for rapid vaporization of the fuel as well as maximized premixing.

It is of course possible for the swirl generator 100 to be designed to be purely conical, that is, without cylindrical initial parts 101*a*, 102*a*. Furthermore, the conical sectional bodies 101, 102 each have a fuel line 108, 109, which lines are arranged along the tangential air-inlet slots 119, 120 and are provided with injection openings 117 through which preferably a gaseous fuel 113 is injected into the combustion air 115 flowing through there, as the arrows 116 are intended to symbolize. These fuel lines 108, 109 are preferably positioned at the latest at the end of the tangential inflow, before entering the conical hollow space 114, in order to obtain optimum air/fuel mixing. As mentioned, the fuel 112 fed through the main nozzle 103 is a liquid fuel in the normal case, a mixture with another formation being readily possible. If the combustion air 115 is additionally preheated or enriched, for example, with recycled flue gas or exhaust gas, this provides lasting assistance for the vaporization of the liquid fuel 112 inside the premix section formed by the length of the burner, before this mixture flows into the downstream combustion stage. The same considerations also apply if liquid fuels are to be supplied via the lines 108, 109. Narrow limits per se are to be adhered to in the configuration of the conical sectional bodies 101, 102 with regard to the cone angle and the width of the tangential air-inlet slots 119, 120 so that the desired flow field of the combustion air 115 can develop at the outlet of the swirl generator 100. In general it may be said that a reduction in the tangential air-inlet slots 119, 120 promotes the quicker formation of a backflow zone already in the region of the swirl generator. The axial velocity inside the swirl generator 100 can be changed by a corresponding feed of an axial combustion-air flow 115*a*, this air flow being maintained in such a way that it does not touch or adversely affect the fuel jet 105. Corresponding swirl generation prevents the formation of flow separations inside the mixing tube arranged downstream of the swirl generator 100. Furthermore, the design of the swirl generator 100 is especially suitable for changing the size of the tangential air-inlet slots 119, 120, whereby a relatively large operational range can be covered without changing the overall length of the swirl generator 100. The sectional bodies 101, 102 may of course be displaced relative to one another in another plane, as a result of which even an overlap of the same can be provided. Furthermore, it is possible to nest the sectional bodies 101, 102 spirally one inside the other by a contra-rotating movement. It is thus possible to vary the shape, size and configuration of the tangential air-inlet slots 119, 120 as desired, whereby the swirl generator 100 can be used universally without changing its overall length.

The geometric configuration of the baffle plates 121*a*, 121*b* is now apparent from FIG. 3. They have a flow-initiating function, in which case, in accordance with their length, they extend the respective end of the conical sectional bodies 101, 102 in the incident-flow direction relative to the combustion air 115. The ducting of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is to be changed dynamically. These dynamic measures may of course also be provided statically by baffle plates forming as and when required a fixed integral part with the conical sectional bodies 101, 102. The swirl generator 100 may likewise also be operated without baffle plates or other aids may be provided for this.

FIG. 4, in comparison with FIG. 3, shows that the swirl generator 100 is now composed of four sectional bodies 130, 131, 132, 133. The associated longitudinal symmetry axes for each sectional body are identified by the letter a. It may be said of this configuration that, on account of the smaller swirl intensity thus produced and in interaction with a correspondingly increased slot width, it is best suited to prevent the breakdown of the vortex flow on the outflow side of the swirl generator in the mixing tube, whereby the mixing tube can best fulfill the role intended for it.

FIG. 5 differs from FIG. 4 inasmuch as the sectional bodies 140, 141, 142, 143 here have a blade-profile shape, which is provided for supplying a certain flow. Otherwise, the mode of operation of the swirl generator is kept the same. The admixing of the fuel 116 with the combustion-air flow 115 is effected from the interior of the blade profiles, i.e. the fuel line 108 is now integrated in the individual blades. Here, too, the longitudinal symmetry axes for the individual sectional bodies are identified by the letter a.

The injection positions of the fuel jet 105 inside the cross section of flow are shown in the aforesaid FIGS. 3–5, these injection positions corresponding to sides of the elements forming the swirl generator remote from the flow of the combustion air or in other words, corresponding to a downstream side of the elements. In the normal case, a nozzle tube is provided for each combustion-air inflow, although such an allocation is not indispensable. The number of fuel jets is preferably adapted to the burner design. The individual fuel jets 105 are positioned to the effect that, while maintaining the fuel-jet angle taken as a basis under FIG. 3, they act along the lee side of the sectional bodies 101 and 102, 130–133, 140–143, as can be seen from FIGS. 3–5, or respectively of the guide blades in the case of a configuration of the swirl generator according to FIG. 8. There, the droplet spray is subjected to smaller aerodynamic forces, so that it is intermixed radially with the combustion air 115 in a more effective manner.

Figure 6:
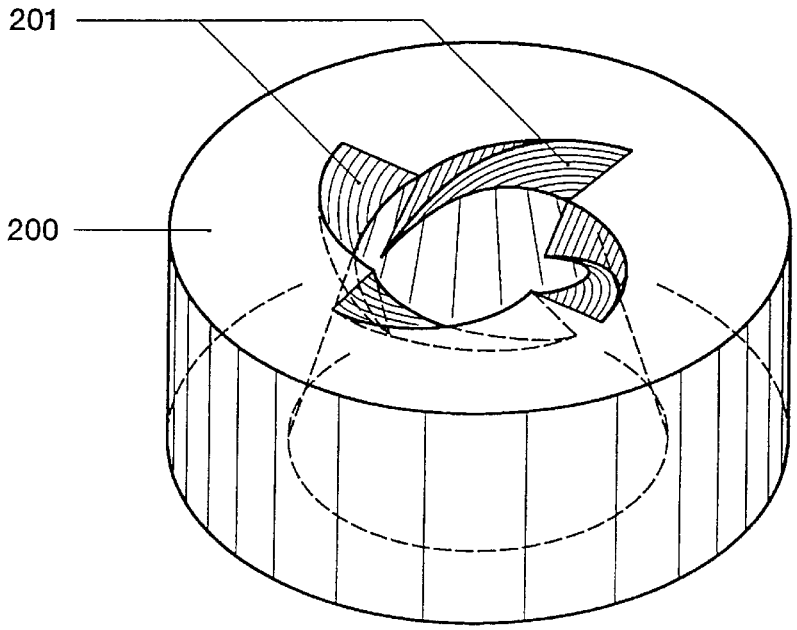
FIG. 6 shows a representation of the form of the transition geometry between swirl generator and mixing tube.

FIG. 6 shows the transition piece 200 in a three-dimensional view. The transition geometry is constructed for a swirl generator 100 having four sectional bodies in accordance with FIG. 4 or 5. Accordingly, the transition geometry has four transition passages 201 as a natural extension of the sectional bodies acting upstream, as a result of which the cone quadrant of the said sectional bodies is extended until it intersects the wall of the tube 20 or the mixing tube 220 respectively. The same considerations also apply when the swirl generator is constructed from a principle other than that described under FIG. 2. The surface of the individual transition passages 201 which runs downward in the direction of flow has a form which runs spirally in the direction of flow and describes a crescent-shaped path, in accordance with the fact that in the present case the cross section of flow of the transition piece 200 widens conically in the direction of flow. The swirl angle of the transition passages 201 in the direction of flow is selected in such a way that a sufficiently large section subsequently remains for the tube flow up to the jump in cross section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube produce a distinct increase in the axial-velocity profile toward the center of the mixing tube, so that the risk of premature ignition is decisively counteracted.

Figure 7:
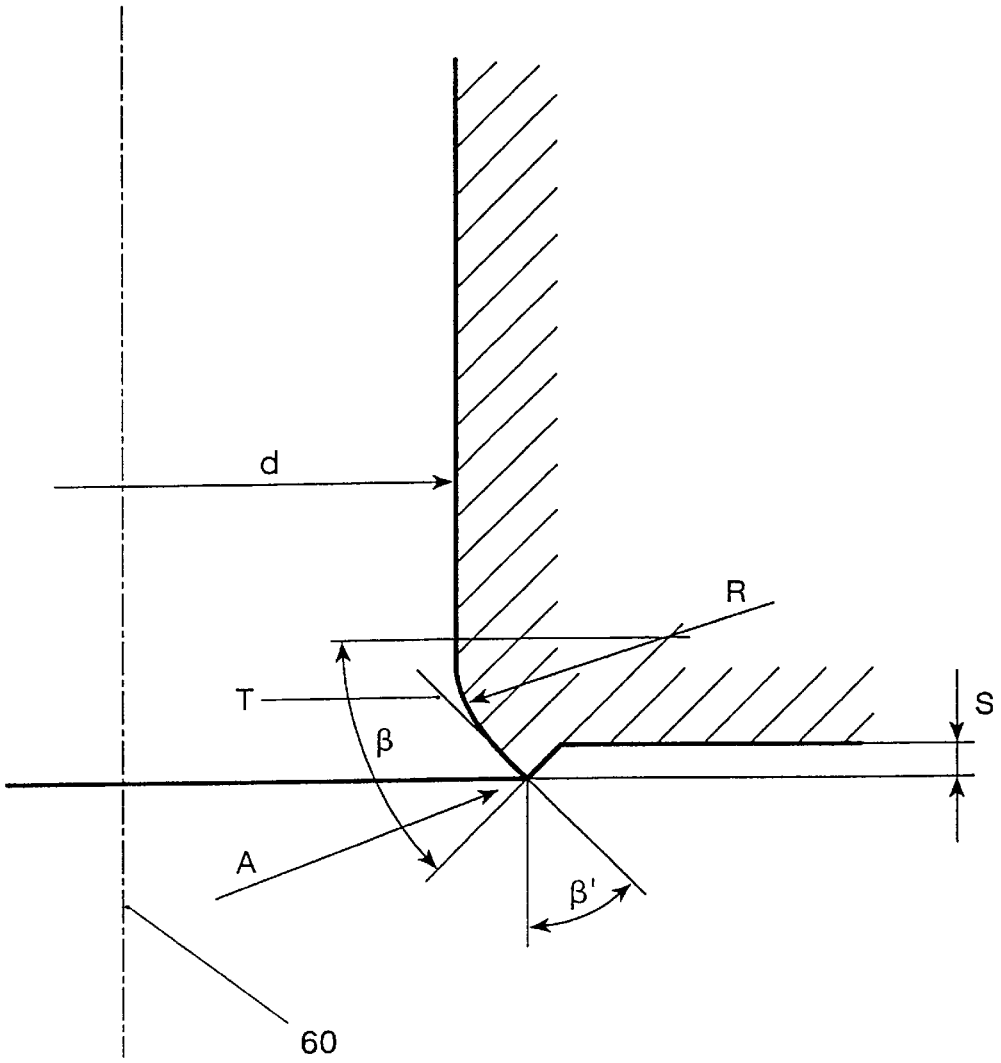
FIG. 7 shows a breakaway edge for the spatial stabilization of the backflow zone.

FIG. 7 shows the breakaway edge already discussed, which is formed at the burner outlet. The cross section of flow of the tube 20 in this region is given a transition radius R, the size of which in principle depends on the flow inside the tube 20. This radius R is selected in such a way that the flow comes into contact with the wall and thus causes the swirl coefficient to increase considerably. Quantitatively, the size of the radius R can be defined in such a way that it is >10% of the inside diameter d of the tube 20. Compared with a flow without a radius, the backflow bubble 50 is now hugely enlarged. This radius R runs up to the outlet plane of the tube 20, the angle β between the start and end of the curvature being <90°. The breakaway edge A runs along one leg of the angle β into the interior of the tube 20 and thus forms a breakaway step S relative to the front point of the breakaway edge A, the depth of which is >3 mm. Of course, the edge running parallel here to the outlet plane of the tube 20 can be brought back to the outlet-plane step again by means of a curved path. The angle β' which extends between the tangent of the breakaway edge A and the perpendicular to the outlet plane of the tube 20 is the same size as angle β. The advantages of this design have already been dealt with in detail under the section "SUMMARY OF THE INVENTION".

FIG. 8 shows a swirl generator 150 which is constructed with the aid of swirl blading 151. A swirl generator is disposed concentrically to the central main nozzle 103 fed with fuel 112 and consists of swirl blading 151, i.e. the blades, arranged in an annular manner here, produce a swirl analogous to that from FIG. 2. The feeding of the combustion air 115 can be effected here with the aid of an annular duct (not shown in any more detail) which extends upstream of the swirl blading 151. Downstream of the swirl blading 151, the central main fuel nozzle 103 has a number of nozzle tubes 104, the fuel jet 105 of which corresponds to the setting angle of the swirl blading 151 relative to the burner axis 60 or respectively the axis of the combustion chamber 30. Here, too, the injection is effected into the wake zones along the lee side of the individual blades of this swirl blading 151, as has already been fully explained further above, the same effects as explained above also being achieved in this configuration according to FIG. 8.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for a heat generator comprising, a swirl generator which is arranged upstream of a combustion zone and is in operative connection with at least one fuel nozzle;

the at least one fuel nozzle being arranged on an outflow side of the swirl generator and an injection angle of a fuel jet belonging to the at least one fuel nozzle corresponding substantially to a setting angle of the elements forming the swirl generator relative to the axis of the burner or the combustion chamber and the fuel jet being directed along the elements forming the swirl generator; and means for introducing an axial combustion-air flow into the swirl generator at a location spaced from the at least one fuel nozzle.

2. The burner as claimed in claim 1, wherein the swirl generator (100) consists of at least two hollow, conical sectional bodies which are nested one inside the other in a direction of flow, wherein the respective longitudinal symmetry axes of these sectional bodies run mutually offset in such a way that the adjacent walls of the sectional bodies form ducts, tangential in their longitudinal extent, for a combustion-air flow to pass through.

3. The burner as claimed in claim 2, wherein a mixing section is arranged downstream of the swirl generator, which mixing section has transition passages, running inside a first part of the section in the direction of flow, for passing a flow formed in the swirl generator into a tube arranged downstream of the transition passages.

4. The burner as claimed in claim 3, wherein the outlet plane of the tube (20) to a combustion chamber is formed with a breakaway edge (A) for stabilizing and enlarging a backflow zone forming downstream.

5. The burner as claimed in claim 4, wherein the breakaway edge (A) comprising of a transition radius (R) in the region of the outlet plane of the tube and of a breakaway step (S) offset from the outlet plane of the tube.

6. The burner as claimed in claim 5, wherein the transition radius (R) is >10% of the inside diameter of the tube, and wherein the breakaway step (S) has a depth >3 mm.

7. The burner as claimed in claim 3, wherein the number of transition passages in the mixing section corresponds to a number of partial flows formed by the swirl generator.

8. The burner as claimed in claim 3, wherein the tube arranged downstream of the transition passages is provided with openings in different longitudinal and circumferential positions for injecting an air flow into the interior of the tube.

9. The burner as claimed in claim 8, wherein the openings run at an acute angle relative to the burner axis of the tube.

10. The burner as claimed in claim 3, wherein a combustion chamber (30) is arranged downstream of the mixing section, wherein there is an increase in cross section between the mixing section and the combustion chamber, which an increase in cross section induces the initial cross section of flow of the combustion chamber, and wherein a backflow zone can take effect in the region of this an increase in cross section.

11. The burner as claimed in claim 2, wherein further fuel nozzles are arranged in the region of the tangential ducts in their longitudinal extent.

12. The burner as claimed in claim 2, wherein the sectional bodies have a blade-shaped profile in cross section.

13. The burner as claimed in claim 2, wherein the sectional bodies are nested spirally one inside the other.

14. The burner as claimed in claim 1, wherein the swirl generator consists of a number of blades (151) arranged in a circle.

15. The burner as claimed in claim 1, wherein the number of fuel nozzles corresponds to at least a number of swirl-forming elements of the swirl generator.

* * * * *